United States Patent [19]

Adams

[11] 4,075,053

[45] Feb. 21, 1978

[54] MASKING TAPE APPLICATOR FOR PIPE

[75] Inventor: Franklin Montague Adams, Forest Hill, Australia

[73] Assignee: Price International, Inc., Sharjan, United Arab Emirates

[21] Appl. No.: 699,626

[22] Filed: June 25, 1976

[51] Int. Cl.[2] ..... B65H 81/00

[52] U.S. Cl. ..... 156/391; 156/490; 156/577; 156/579

[58] Field of Search ..... 156/391, 392, 489, 490, 156/523, 574, 577, 579; 156/425, 457, 486, 575, 524, 526, 527

[56] References Cited

U.S. PATENT DOCUMENTS

| | | | |
|---|---|---|---|
| 474,629 | 5/1892 | Coe | 156/577 |
| 2,192,634 | 3/1940 | Blomquist | 156/523 |
| 2,239,932 | 4/1941 | Richards | 156/526 |
| 2,591,136 | 4/1952 | Cleary et al. | 156/391 |
| 3,310,452 | 3/1967 | Hartley et al. | 156/523 |
| 3,325,336 | 6/1967 | Gibson | 156/577 |
| 3,340,131 | 9/1967 | Leibow | 156/579 |
| 3,388,039 | 6/1968 | Gillis et al. | 156/457 |
| 4,012,273 | 3/1977 | Inka | 156/490 |

*Primary Examiner*—Charles E. Van Horn
*Assistant Examiner*—M. G. Wityshyn
*Attorney, Agent, or Firm*—Loew, Kokjer, Kircher, Wharton & Bowman

[57] ABSTRACT

A device which applies a strip of masking tape to a pipe, particulary to the inside pipe surface. A frame carries a pair of rollers which roll along the inside pipe surface. The tape is mounted on a reel and is unwound in a strip which is pressed against the inside pipe surface by the rollers. An outer guide roller is carried on a hand lever assembly and is biased against the outside surface of the pipe in order to maintain the inner rollers against the inside pipe surface. The hand lever may be pulled away from the pipe to disengage the outer roller therefrom for removal of the applicator device from the pipe.

1 Claim, 3 Drawing Figures

MASKING TAPE APPLICATOR FOR PIPE

BACKGROUND AND SUMMARY OF THE INVENTION

This invention relates generally to a tape applicator device and deals more specifically with a device that is particularly useful in taping the inside surface of a pipe.

In order to improve fluid flow characteristics for pipelines, it is common practice to apply coatings to the internal surfaces of the individual joints of pipe before they are installed into the pipeline. Such coatings may also be applied for corrosion protecting purposes. To facilitate welding or for other reasons, coating specifications often require that such internal coatings terminate short of the ends of the pipe to leave a narrow uncoated band on the pipe surface. Masking tape is often applied at these locations to mask the area during the coating operation.

According to prior art techniques, the masking tape is usually applied by hand to the interior surface of the pipe at the ends adjacent the terminal edges. This, of course, requires considerable time and labor which increases the cost significantly and holds up preparation of the pipe for coating. Furthermore, regardless of the care taken by the workmen, the manual procedure invariably results in somewhat inaccurate and uneven application of the tape to the pipe. Such an application may not afford adequate protection for the interior pipe surface.

It is an object of the present invention to provide a tape applicator device which is able to quickly and easily apply a strip of masking tape to a curved pipe surface.

Another object of the invention is to provide a tape applicator device of the character described which is particularly adapted to accurately apply tape to the inside pipe surface without wrinkles or other uneveness in the tape.

A further object of the invention is to provide a tape applicator device of the character described which is firmly held on the pipe during use and yet may be easily removed when desired.

An additional object of the invention is to provide a tape applicator device of the character described which includes rollers that roll smoothly along the pipe for application of the tape thereto and accurate guiding of the device around the pipe.

Yet another object of the invention is to provide a device of the character described in which used tape rolls may be quickly and easily replaced by fresh rolls.

A still further object of the invention is to provide a device of the character described which is economical to construct and easy for a single worker to operate.

Other and further objects of the invention, together with the features of novelty appurtenant thereto, will appear in the course of the following description.

DETAILED DESCRIPTION OF THE INVENTION

Figure 1:
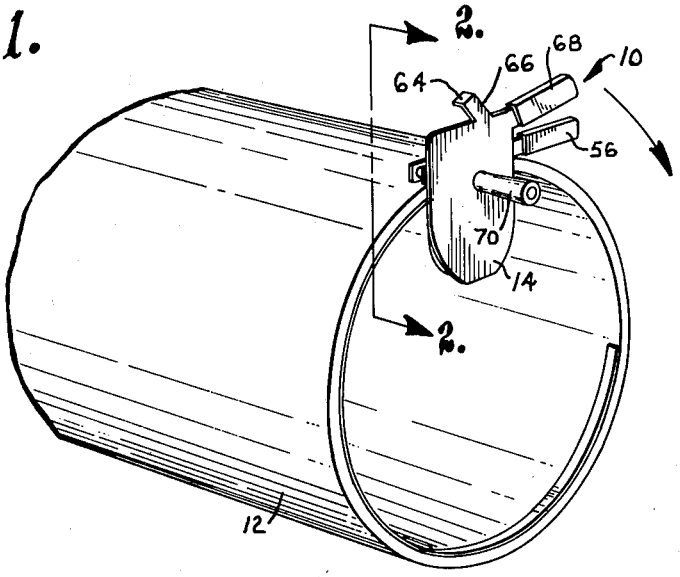
Figure 3:
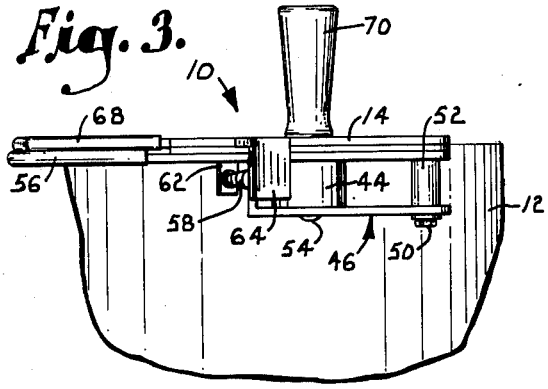
Figure 2:
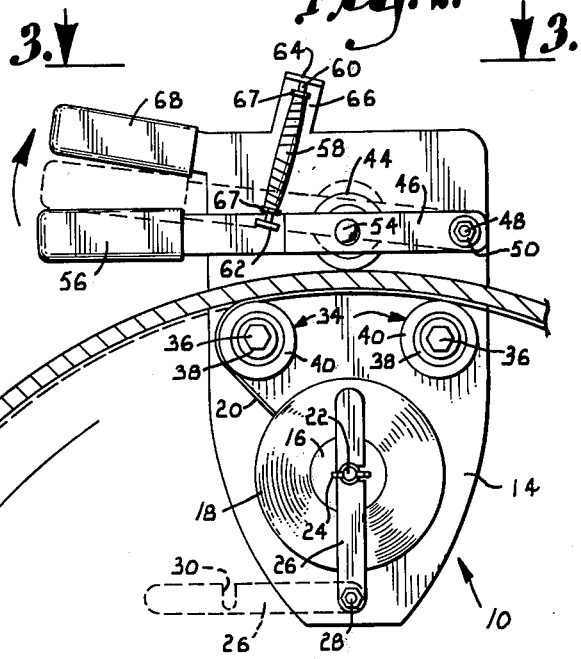
Figure 2:
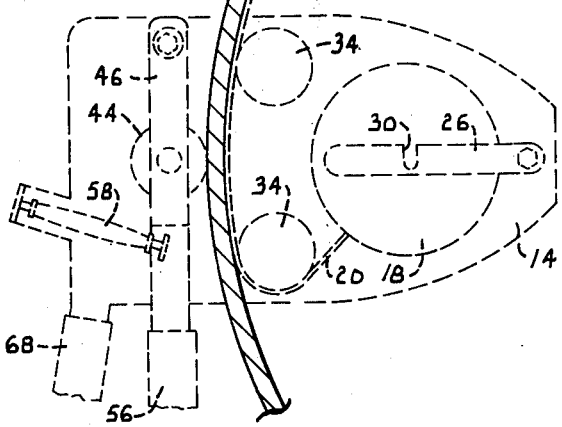

In the accompanying drawing which forms a part of the specification and is to be read in conjunction therewith and in which like reference numerals are used to indicate like parts in the various views:

FIG. 1 is a perspective view illustrates the tape applicator device of the present invention in operation to apply tape to the inside surface of a pipe;

FIG. 2 is an elevational view on an enlarged scale taken generally along line 2—2 of FIG. 1 in the direction of the arrows, with the broken line position of the tape applicator indicating movement thereof approximately 90° around the pipe from the solid line position, and the broken line positions of the hand lever and retaining arm indicating mmovement thereof to release positions; and FIG. 3 is a top plan view taken generally along line 3—3 of FIG. 2 in the direction of the arrows, the pipe being shown only fragmentarily.

Referring now to the drawing in detail, a tape applicator device constructed according to a preferred embodiment of the invention is generally designated by reference numeral 10. The applicator device 10 functions to apply masking tape to a cylindrical pipe which is designated by numeral 12. The frame or body of the device is a flat metal plate 14. The functional components of the device are mounted on one side of plate 14, as best shown in FIG. 2.

A circular reel 16 is carried rotatively on the lower portion of plate 14. Reel 16 serves to mount a standard masking tape roll 18 from which the tape is unwound and dispensed in a strip 20 which is applied to the inside of pipe 12 near the end thereof. Reel 16 is rotatively mounted on a stud 22 which projects from plate 14 and which is threaded on its end to receive a wing nut 24. A retaining arm 26 is pivoted at its lower end to plate 14 by a pivot coupling 28. A notch 30 is formed in one side of arm 26 at a location to register with stud 22. With notch 30 fit on stud 22, wing nut 24 may be tightened down to lock arm 26 in the solid line position of FIG. 2. In this position, the retaining arm 26 lies substantially across reel 16 and the tape roll 18 in order to retain them on plate 14, while permitting them to rotate freely.

When a tape roll has been used up and is to be replaced by a fresh roll, wing nut 24 is loosened to release arm 26 which may then be swung about its lower end to the release position shown in broken lines in FIG. 2. With arm 26 out of the way, a full tape roll may be installed on reel 16, or the reel itself may be removed from stud 22.

With continued reference to FIG. 2, plate 14 carries a pair of rollers 34 which roll along the inside surface of pipe 12 to apply the tape strip 20 thereto. Rollers 34 are spaced laterally from one another and are mounted to rotate on parallel studs 36 which extend from plate 14. Each roller 34 preferably comprises a central metal hub portion 38 and an outer sleeve portion 40 which is rigidly mounted on the hub. The sleeves 40 are preferably constructed of a rather hard rubber substance so that the rollers present hard, but slightly yieldable, contact surfaces on their peripheries.

A third roller 44 serves essentially as a guide roller which rolls against the outside pipe surface. Roller 44 is mounted for rotation within a U-shaped yoke 46 which is in turn pivotally mounted to plate 14. A threaded stud 48 extends from the upper right portion of plate 14 as viewed in FIG. 2, and yoke 46 is mounted to pivot on stud 48. A nut 50 is threaded on the end of stud 48 to secure the yoke thereon, and a spacer 52 (FIG. 3) is fit on stud 48 to maintain the spacing between the legs of the yoke. Roller 44 is mounted to rotate within the yoke on a stud 54 which extends between the yoke legs at a location above rollers 34 and substantially centered therebetween, as shown in FIG. 2. Roller 44 is constructed substantially the same as rollers 34 so that it presents hard rubber contact surface on its periphery.

A hand lever 56 which is provided with a hand grip is used to pivot yoke 46 about stud 48 and thus to move the guide roller 44 generally toward and away from the inside applicator rollers 34. Lever 56 is formed as an extension of the inner leg of yoke 46 and is closely spaced from plate 14. The left end of lever 56 (as viewed in FIG. 2) projects well beyond the edge of plate 14 and is thus readily accessible for manual grasping.

A compression spring 58 serves to continuously urge yoke 46 in a direction such that roller 44 is biased generally toward rollers 34 and against the outer surface of pipe 12. spring 58 is fit around a threaded rod 60 which is secured at its lower end to a lug 62 that projects from lever 56. The upper end of rod 60 is secured to a lug 64 that is formed on an extension piece 66 that projects from the top edge of plate 14. The ends of spring 58 bear against nuts 67 that are threaded on rod 60 and may be adjusted to vary the biasing force of spring 58. The action of spring 58 continuously urges lever 56 toward the solid line position of FIG. 2 in order to maintain roller 44 against the outside pipe surface.

A stationary handle 68 which is preferably provided with a hand grip extends from plate 14 at a location near lever 56 so that the hand lever may be easily manipulated with one hand. Another handle 70 (see FIGS. 1 and 3) is mounted to the side of plate 14 opposite the side of the remaining components of the applicator device. Handle 70 is preferably contoured for easy gripping, and it serves to facilitate the movement of the device around the pipe 12.

In use, a tape roll 18 is mounted on rell 16 and a tape strip 20 is drawn from the roll and initially passed at least partially around the leading or left hand (FIG. 2) applicator roller 34, with the adhesive side of the tape facing away from the roller. Lever 56 is pulled toward handle 68 to move roller 44 generally away from rollers 34. The applicator device may then be installed on the end of pipe 12, with roller 44 on the outside of the pipe and the tape strip 20 located between the inside pipe surface and the leading inner roller 34. Plate 14 is perpendicular to the pipe axis, and the rotational axes of rollers 34 and 44 are parallel thereto. When lever 56 is released, the spring 58 acts to press 44 firmly against the outside pipe surface which in turn draws both of the inner rollers 34 against the inside pipe surface. The leading applicator roller 34 thus presses the tape strip 20 against the inside pipe surface.

Handle 70 is grasped and the applicator device 10 is then rolled around pipe 12 as indicated by the directional arrow in FIG. 2. The left hand or leading inside roller 34 unwinds the tape strip from roll 18 and rolls against the strip to firmly apply it to the inside surface of pipe 12. The following or right hand roller 34 subsequently rolls over the strip 20 to smooth out any wrinkles and assure that it is firmly pressed against the pipe. As the device moves around the pipe, the action of spring 58 maintains the outer guide roller 44 against the outside surface of the pipe and the inner rollers 34 against the inside pipe surface. Spring 58 is able to accommodate movement of the rollers as they pass over any rough or irregular areas on the pipe. Roller 44 is located substantially midway between rollers 34 so that any tendency of the device to tilt or become misaligned on the pipe is resisted.

When the applicator device 10 has passed completely around the pipe so that strip 20 overlaps itself, the tape may be cut or torn. Lever 56 may be pulled toward handle 68 to disengage the guide roller 44 from the pipe so that the applicator device may be removed.

It is thus apparent that the present invention provides an applicator device that is able to quickly, easily, and accurately apply a strip of tape to a curved surface such as the inside surface of a pipe. Although a pair of inside rollers 34 are preferably included to provide three point contact with the pipe for stability and firmness of tape application, it should be evident that a single roller 34 would suffice in many situations. It should also be evident that the tape applicator device is equally useful in applying a strip of tape to the outside surface of a pipe or other curved surface, even though it is contemplated that its primary use will be for interior curved surface tape application.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A device for applying tape to the inside surface of a pipe, said device comprising:

a frame;

a pair of tape applicator rollers rotatably mounted on said frame at spaced apart locations theron and adapted to roll in a generally circumferential direction along the inside pipe surface in a manner to press a strip of tape thereagainst;

tape support means on said frame for supporting a roll of tape and dispensing tape from the roll in a strip, said tape support means being located approximately on an imaginary perpendicular bisector of a straight line extending between said applicator rollers and being disposed within the pipe when said applicator rollers are applied to the inside surface thereof;

a guide roller rotatably mounted on said frame and adapted to roll along the outside pipe surface in opposition to said applicator and guide rollers; and resilient means for urging said applicator and quide rollers generally toward one another to maintain the rollers in rolling contact with the pipe as said frame moves around same.

* * * * *